US010801200B2

(12) United States Patent
Figueroa

(10) Patent No.: US 10,801,200 B2
(45) Date of Patent: Oct. 13, 2020

(54) COVERTEC WALL MODULE BUILDING SYSTEM AND METHOD

(71) Applicant: Victor Figueroa, Toa Alta, PR (US)

(72) Inventor: Victor Figueroa, Toa Alta, PR (US)

( * ) Notice: Subject to any disclaimer, the term of this patent is extended or adjusted under 35 U.S.C. 154(b) by 0 days.

(21) Appl. No.: 15/952,867

(22) Filed: Apr. 13, 2018

(65) Prior Publication Data

US 2019/0161964 A1 May 30, 2019

Related U.S. Application Data

(60) Provisional application No. 62/591,902, filed on Nov. 29, 2017.

(51) Int. Cl.

| | |
|---|---|
| ***E04B 2/00*** | (2006.01) |
| ***E04B 2/86*** | (2006.01) |
| ***E04G 17/06*** | (2006.01) |
| ***E04B 1/16*** | (2006.01) |

(52) U.S. Cl.

CPC ..... *E04B 2/8611* (2013.01); *E04B 1/167* (2013.01); *E04B 2/8629* (2013.01); *E04G 17/06* (2013.01); *E04B 2103/02* (2013.01)

(58) Field of Classification Search

CPC . E04C 2/386; E04C 2/388; E04C 2/26; E04C 2/06; E04B 2/84; E04B 2/68

See application file for complete search history.

(56) References Cited

U.S. PATENT DOCUMENTS

| | | | | | |
|---|---|---|---|---|---|
| 2,338,246 | A * | 1/1944 | Hoge | E04C 2/06 | 52/592.1 |
| 4,223,501 | A * | 9/1980 | DeLozier | E04B 2/40 | 52/309.12 |
| 5,568,710 | A * | 10/1996 | Smith | E04B 2/40 | 52/309.11 |
| 5,596,855 | A * | 1/1997 | Batch | E04C 1/40 | 52/309.11 |
| 5,638,651 | A * | 6/1997 | Ford | E04C 2/246 | 52/265 |
| 5,822,940 | A * | 10/1998 | Carlin | E04B 2/7453 | 52/479 |
| 5,899,037 | A * | 5/1999 | Josey | E04B 2/58 | 428/118 |
| 6,698,150 | B1 * | 3/2004 | DiLorenzo | E01F 8/0029 | 52/250 |
| 7,254,925 | B2 * | 8/2007 | Stefanutti | E02D 27/02 | 249/35 |
| 7,421,828 | B2 * | 9/2008 | Reynolds | E04B 1/161 | 52/319 |
| 7,549,263 | B1 * | 6/2009 | Porter | E04B 1/14 | 52/127.7 |
| 7,666,258 | B2 * | 2/2010 | Guevara | C04B 16/08 | 106/724 |
| 7,790,302 | B2 * | 9/2010 | Ladely (Guevara) | E04B 5/043 | 106/778 |

(Continued)

*Primary Examiner* — Gisele D Ford

(74) *Attorney, Agent, or Firm* — Luis Figarella

(57) ABSTRACT

A module, system and method for the utilization of wall modules molds which may be enjoined in various combinations, filled in situ with concrete, cement or similar aggregates aggregate and linked so that said when solidified, said concrete, cement or similar aggregates aggregate combines with said molds to form a continuous structural wall that may be used in the construction of dwellings and other such buildings.

6 Claims, 10 Drawing Sheets

(56) References Cited

U.S. PATENT DOCUMENTS

| | | | | |
|---|---|---|---|---|
| 7,963,080 | B1 * | 6/2011 | Bowman | E04B 5/043 52/309.1 |
| 8,161,699 | B2 * | 4/2012 | LeBlang | E04B 1/165 52/252 |
| 8,176,696 | B2 * | 5/2012 | LeBlang | E04B 1/165 52/252 |
| 8,327,592 | B2 * | 12/2012 | Lafferty, III | E04B 1/26 52/293.3 |
| 2003/0172607 | A1 * | 9/2003 | Brandes | E04B 1/24 52/309.7 |
| 2004/0177581 | A1 * | 9/2004 | Starke | E04C 2/384 52/481.1 |
| 2007/0125042 | A1 * | 6/2007 | Hughes | B32B 5/18 52/782.1 |
| 2011/0030288 | A1 * | 2/2011 | Traulsen | E04B 1/04 52/126.1 |
| 2012/0047816 | A1 * | 3/2012 | Zhong | E04B 1/161 52/11 |
| 2017/0167137 | A1 * | 6/2017 | Erickson | E04C 2/2885 |

* cited by examiner

COVERTEC WALL MODULE BUILDING SYSTEM AND METHOD

CROSS-REFERENCE TO RELATED APPLICATIONS

This application claims priority to U.S. Provisional patent application Ser. No. 62/591,902 titled "Covertec System and Method", filed on Nov. 29, 2017 the disclosure of which is herein incorporated by reference in its entirety.

PATENTS CITED

The following documents and references are incorporated by reference in their entirety, Aiken (U.S. Pat. No. 1,549,951), Bravo et al (U.S. Pat. No. 9,556,629), Cox et al (U.S. Pat. No. 3,898,776), LeBlang (U.S. Pat. Pub. No. 2010/0058700 and U.S. Pat. No. 8,763,331), Swerdlow et al (U.S. Pat. No. 4,338,759) and Perrin (U.S. Pat. No. 5,867,964).

FIELD OF THE INVENTION

The present invention relates to a system and method for the creation and use of wall molds, and particularly to a system and method for the utilization of wall molds which may be enjoined in various combinations, filled in situ with concrete, cement or similar aggregates and linked so that said when solidified, said concrete, cement or similar aggregates combines with said molds to form a continuous structural wall that may be used in the construction of dwellings and other such buildings.

DESCRIPTION OF THE RELATED ART

In many locations, particularly the tropics, there is a predilection for concrete structures. These are traditionally built using individual concrete blocks, a labor-intensive process. Alternatively, they are built using concrete panels that are held by steel frames. This is a faster process, but usually requires powerful cranes or other mechanical contrivances to move them.

Many of the proposed solutions use mechanical linkages to form the two or more panels onto a wall, however, this creates a wall that over time will have the links (typically bolts/nuts) that form it corrode and fail. What is needed is a process by which structural walls may be brought and assembled and securely attached to each other to form a single entity that performs the wall functions, then filled with concrete, cement and/or similar aggregates in-situ, allowing for a solid result that requires the smallest number of heavy equipment elements.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

In one aspect the invention is about a wall building module comprising two or more side walls, two or more internal walls, each said internal wall attached to each said side wall, forming one or more cavities along the height of said module, each end forming a join cavity, one or more rebars extending horizontally across the width of said module, going through said internal walls and extending into a portion of the join cavity at each end and one or more vertical rebars extending from the bottom of said module to over the top. In another aspect said side walls and said internal walls are made from one or a combination of: fiber cement board, cellulose fiber, fiberglass, carbon composite and/or plywood.

In one aspect, the invention is about a system for building walls comprising two or more wall building modules, each said module comprising, two or more side walls, two or more internal walls, each said internal wall attached to each said side wall, forming one or more cavities along the height of said module, each end forming a join cavity, one or more rebars extending horizontally across the width of said module, going through said internal walls and extending into a portion of the join cavity at each end and one or more vertical rebars extending from the bottom of said module to over the top, wherein two or more of said modules are concatenated so that one or more join cavities are formed at the juncture of said modules and upon filling by concrete, cement and/or similar aggregates, two or more of said cavities and/or join cavities one or more walls are formed. In another aspect said side walls and said internal walls are made from one or a combination of: fiber cement board, cellulose fiber, fiberglass, carbon composite and/or plywood.

In one aspect, the invention is about a method for building walls comprising providing two or more wall building modules, each said module comprising, two or more side walls, two or more internal walls, each said internal wall attached to each said side wall, forming one or more cavities along the height of said module, each end forming a join cavity, one or more rebars extending horizontally across the width of said module, going through said internal walls and extending into a portion of the join cavity at each end and one or more vertical rebars extending from the bottom of said module to over the top, wherein two or more of said modules are concatenated so that one or more join cavities are formed at the juncture of said modules and filling by concrete, cement and/or similar aggregates, two or more of said cavities and/or join cavities one or more walls are formed. In another aspect, said side walls and said internal walls are made from one or a combination of: fiber cement board, cellulose fiber, fiberglass, carbon composite and/or plywood.

Other features and advantages of the present invention will become apparent upon examining the following detailed description of an embodiment thereof, taken in conjunction with the attached drawings.

Figure 1:
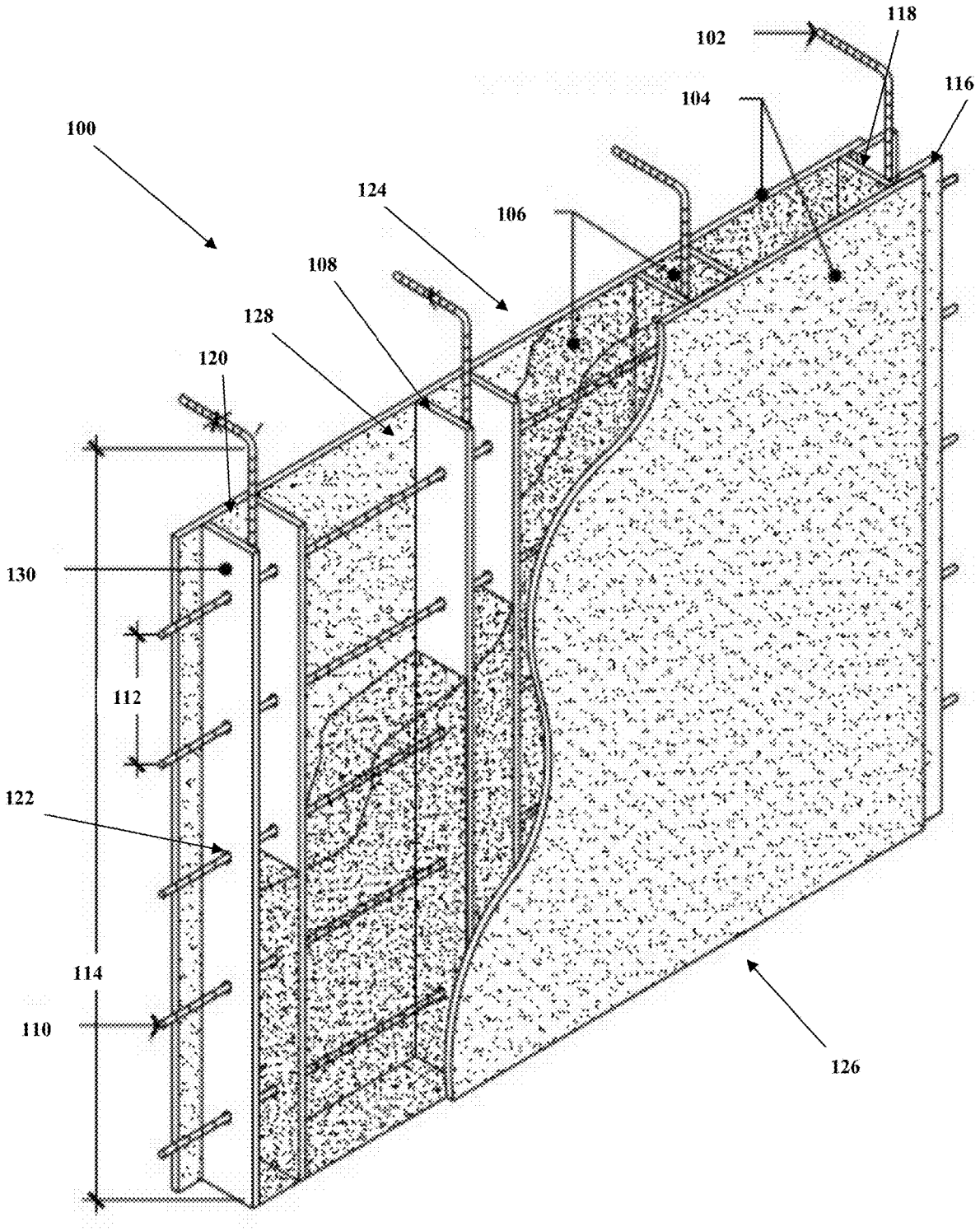
FIG. 1 shows an isometric transparent component view of the basic Covertec wall module, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
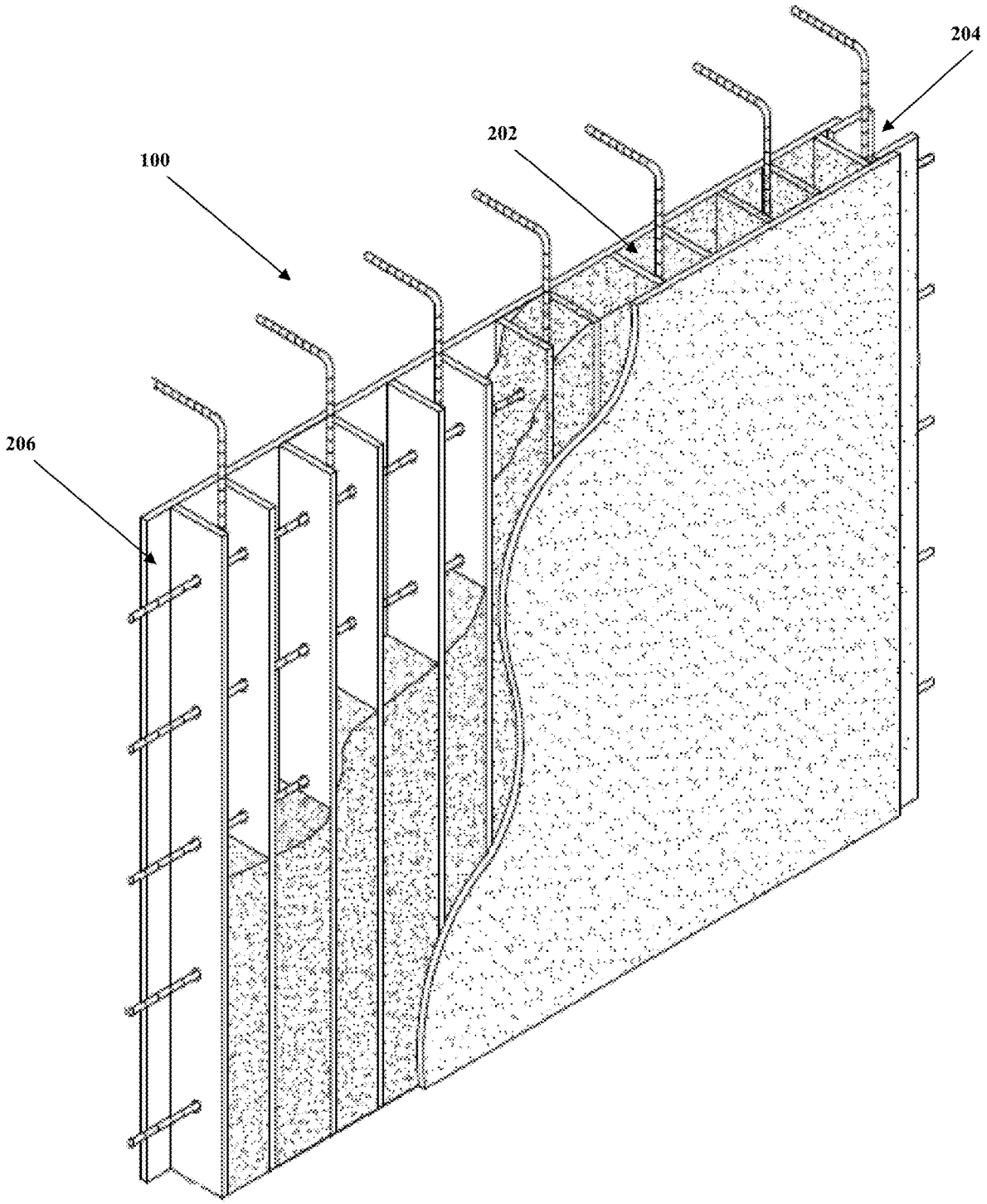
FIG. 2 shows an isometric inside component view of the basic Covertec wall module, according to an exemplary embodiment of the invention.
Figure 3:
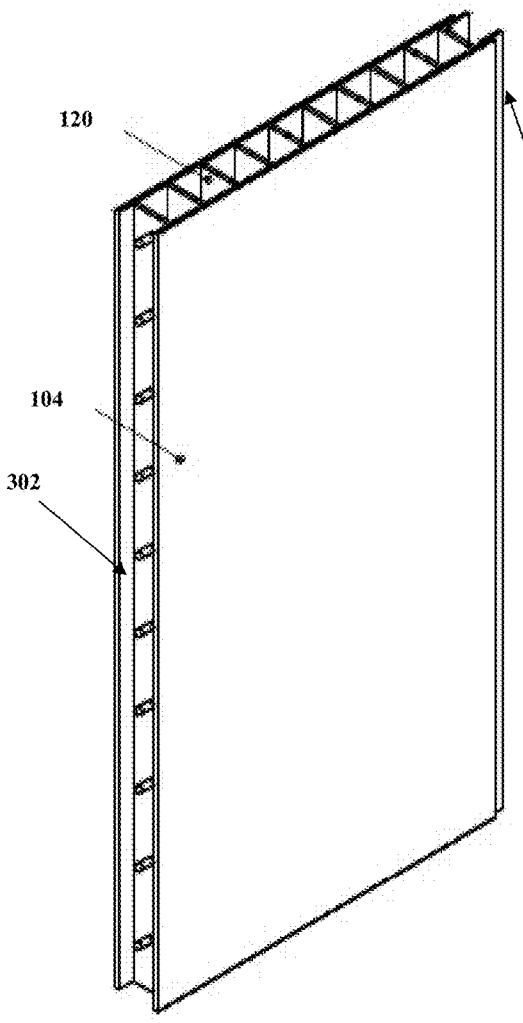
FIGS. 3-4 show external isometric views of the Covertec wall modules, according to exemplary embodiments of the invention.
Figure 4:
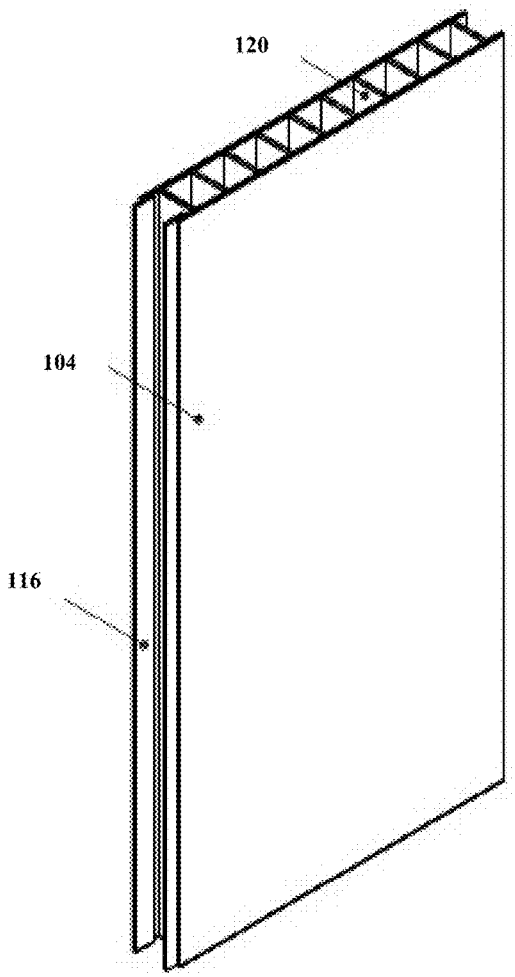
Figures 5, 6:
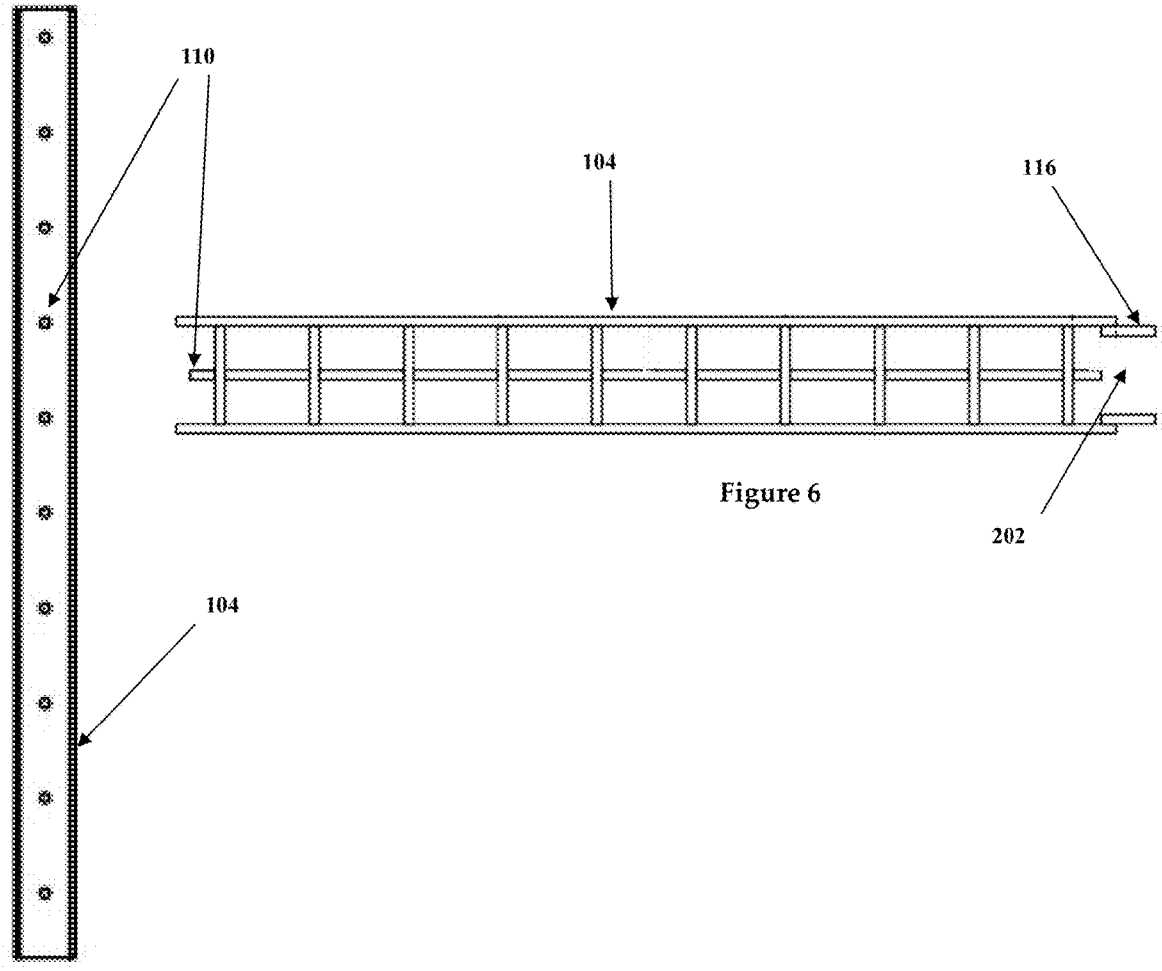
FIG. 5 shows a side view of the Covertec wall module, according to an exemplary embodiment of the invention.
FIG. 6 shows a top view of the Covertec wall module, according to an exemplary embodiment of the invention.
Figure 7:
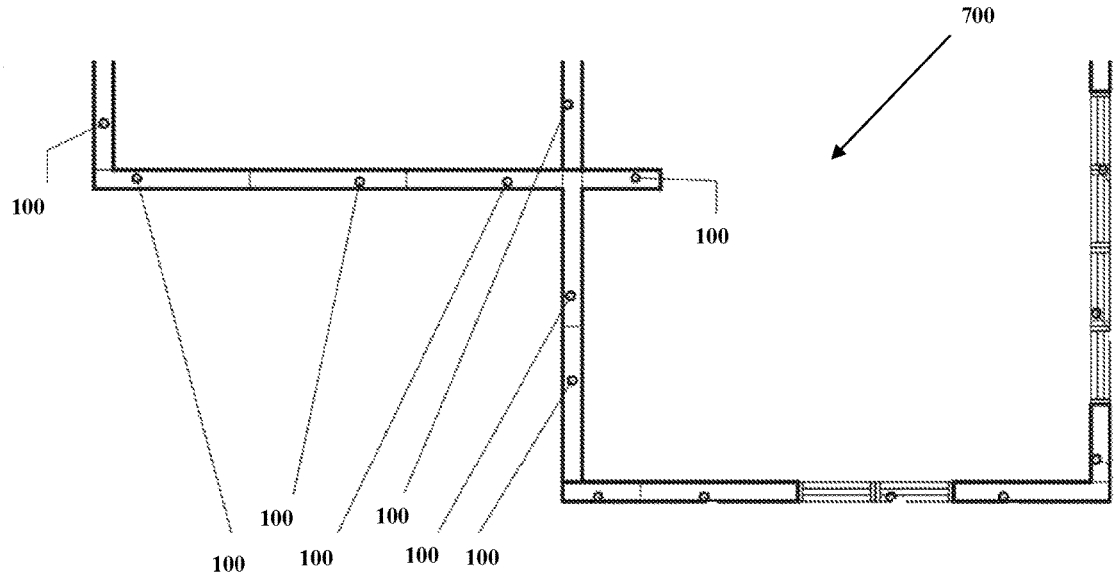
FIG. 7 shows a top view of a dwelling formed by the combination of two or more Covertec wall modules, according to an exemplary embodiment of the invention.
Figure 8:
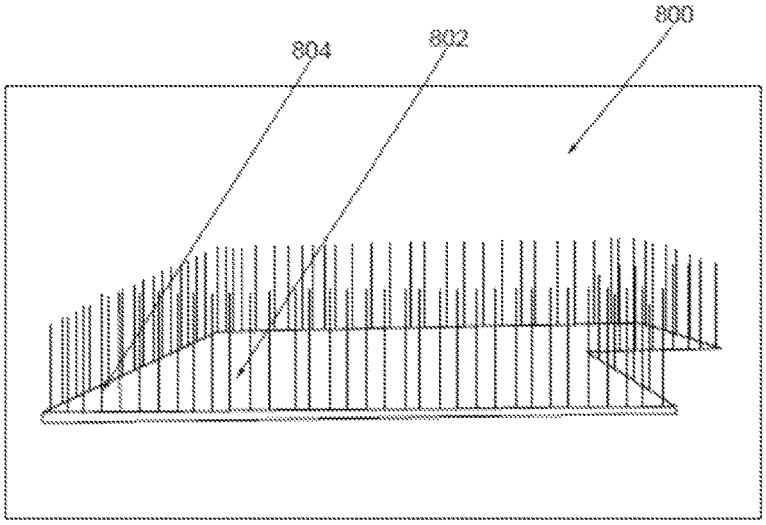
FIG. 8 shows the initial prepared slab and interconnection components prior to the installation of the Covertec wall modules, according to an exemplary embodiment of the invention.
Figure 9:
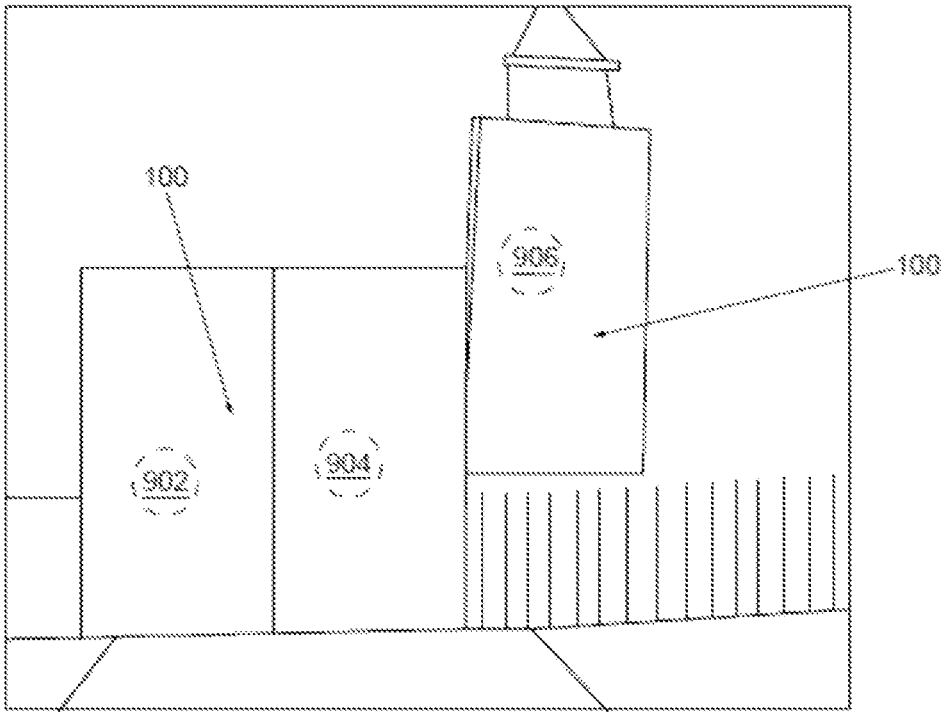
FIG. 9 shows the placement of two or more Covertec wall models along the edge of a prepared slab, according to an exemplary embodiment of the invention.
Figure 10:
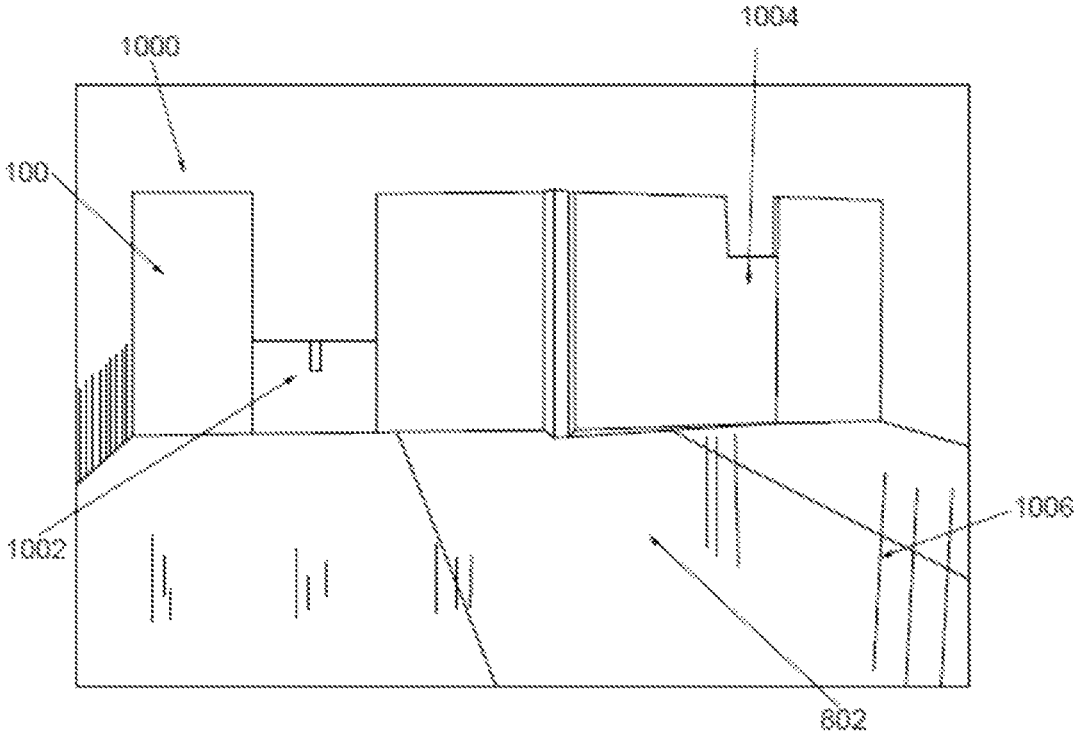
FIG. 10 shows the placement of modified two or more Covertec wall models in order to form a continuous dwelling wall, according to an exemplary embodiment of the invention.
Figure 11:
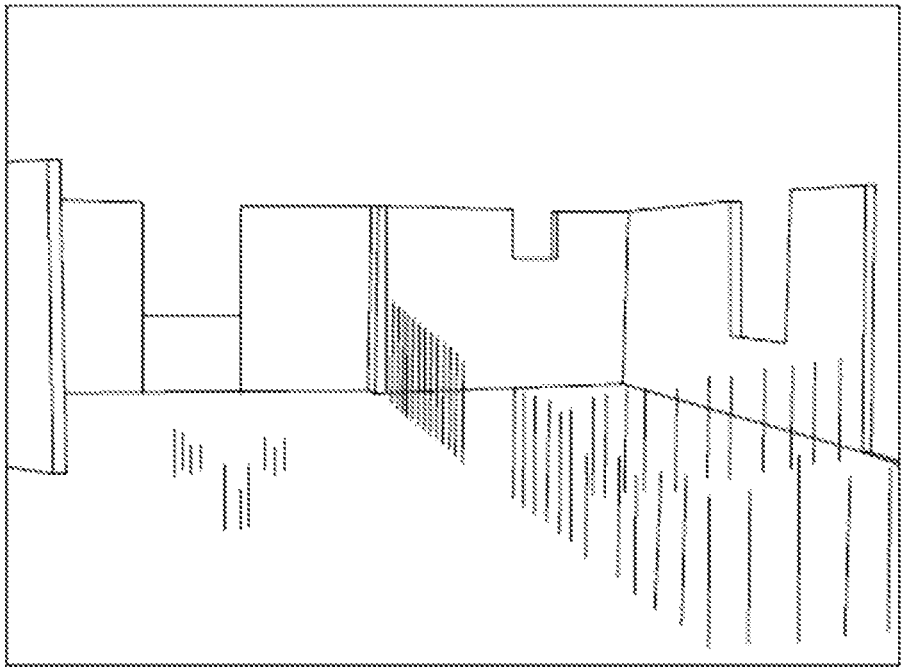
FIG. 11 shows the placement of two or more Covertec walls to form a dwelling corner, according to an exemplary embodiment of the invention.
Figure 12:
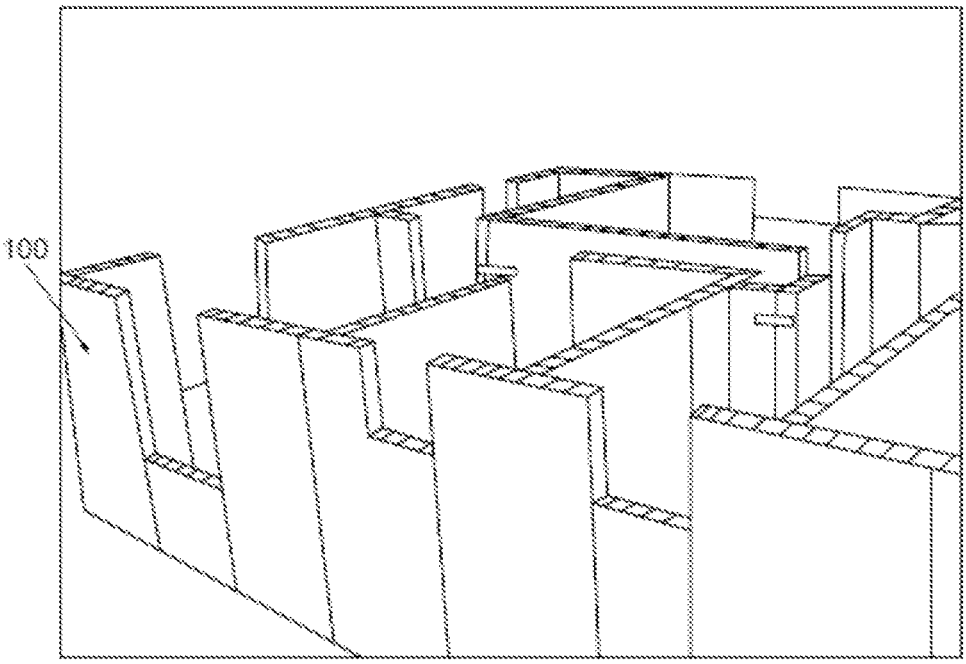
FIGS. 12-13 show the placement combined walls forming a dwelling's internal and external walls, according to exemplary embodiments of the invention.
Figure 13:
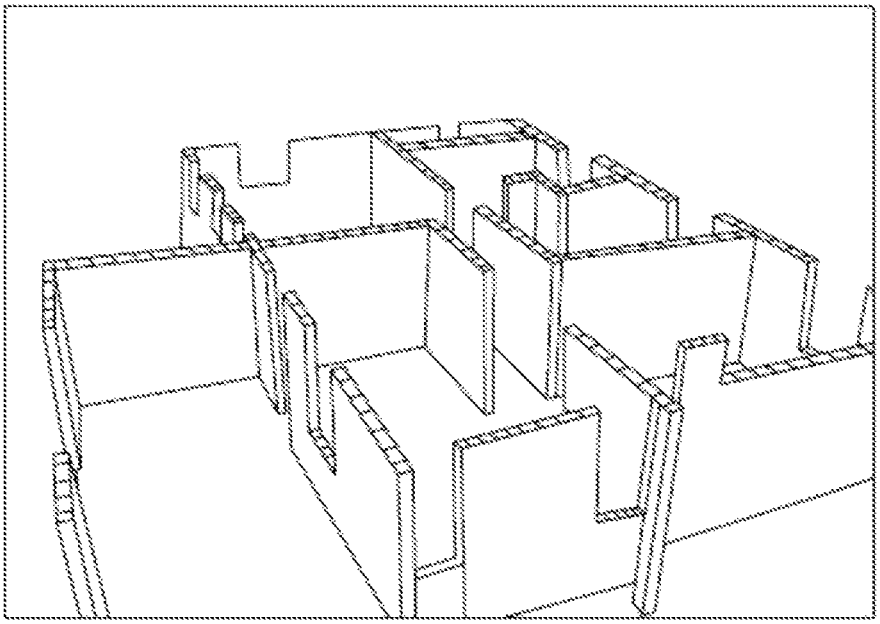
Figure 14:
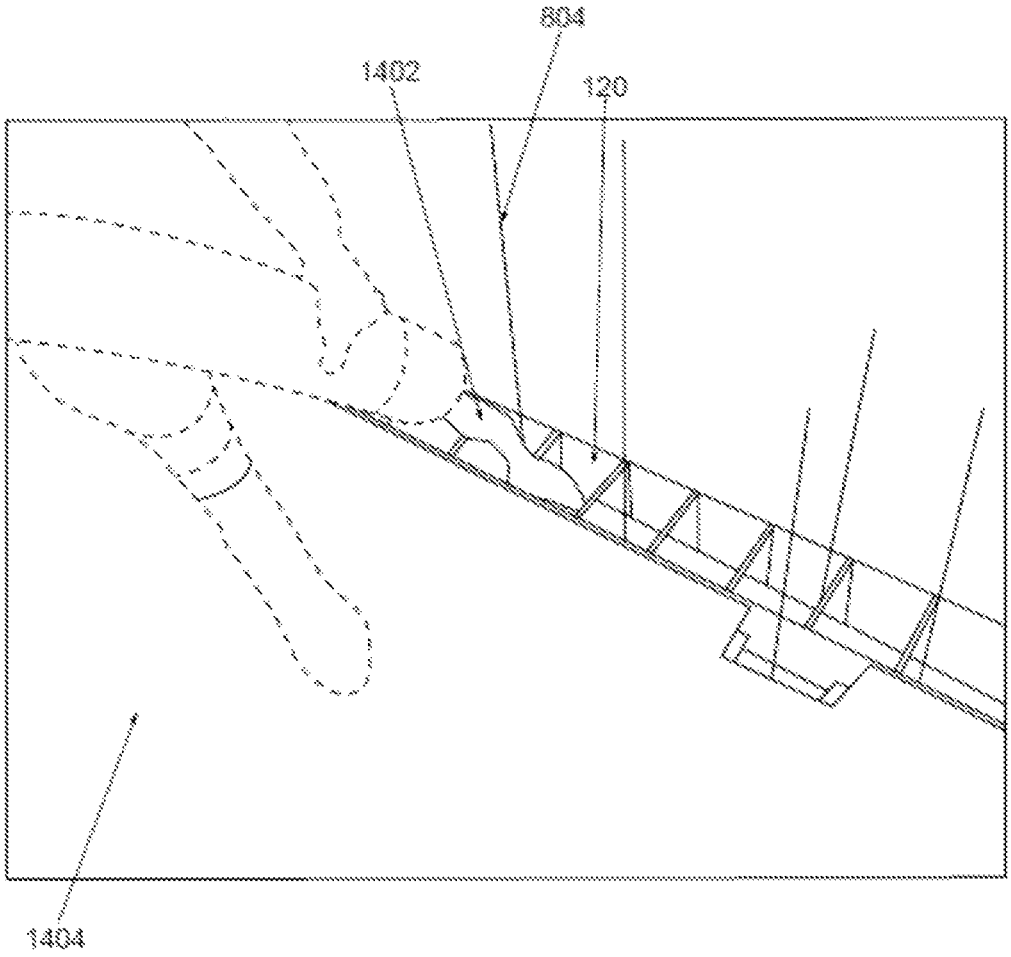
FIG. 14 shows the filling of the openings along the Covertec wall modules with concrete, cement and/or similar solidifying aggregates to form a wall, according to an exemplary embodiment of the invention.

Referring to FIG. 1 we see an illustrative embodiment of the proposed Covertec wall module 100. This is the basic module to be used, with minor modifications, in creating one or more continuous walls for dwelling or space thru the combination of one or more of said modules. Each Covertec module is comprised of two or more board panels or side walls 104, that are significantly parallel to each other. These side walls 104 are attached to each other via two or more internal walls 108, so that the combination of side walls 104 and internal walls 108 form a cavity 120 extending from the top of said wall module 100 to the bottom. In one embodiment, the cavity is formed as a rectangle 128 and square 120 combination, in another embodiment (FIG. 2), the cavities are all formed as squares 204/206 concatenated with the cavities 202, and other shaped cavities may be formed.

In one embodiment, the cavities 202 and/or join cavities 204/206 are preferably filled with concrete, cement and/or similar aggregates in the entirety. Various concrete and/or cement mixes may be used, where in general concrete is a heavy, rough building material made from a mixture of broken stone or gravel, sand, cement, and water, that can be spread or poured into molds and that forms a stone-like mass on hardening. In alternate embodiments, one or more of the cavities 202 may be filled with lighter materials, including lighter versions of concrete and/or foam, etc.

The internal walls 108 are preferably attached to the side walls 104 via epoxy or similar chemical gluing means, but may also be mechanically attached via screws/nails and others such components. Rebars, also known as reinforcing bar, are typically made from steel, although other tensile strength (metals and composites) may be used. They are used in two directions within the module 100. One or more vertical steel rebars 102 extend along the height of said wall module 100, and one or more horizontal steel rebar 110 extend along the length of the module 100. In one embodiment, the vertical rebar 102 and horizontal rebar 110 are attached to each other, so that the openings 122 through which the horizontal rebar 110 crosses the internal/interior wall(s) 108 serve to keep the lattice of rebar centered.

The walls 104/108 (both external and internal) may be made of the combination of any suitable material. These include fiber cement board panels [typically comprised of Portland cement (as high as 90%), ground sand, cellulose fiber and selected additives], fiberglass (a composite comprised of epoxy and fiber panels), carbon composite, plywood or any other suitable similar material. An advantage of the fiber cement board is their non-combustible construction and their ability to repel water, so that the Covertec module on the outside may simply be painted.

Figure 15:
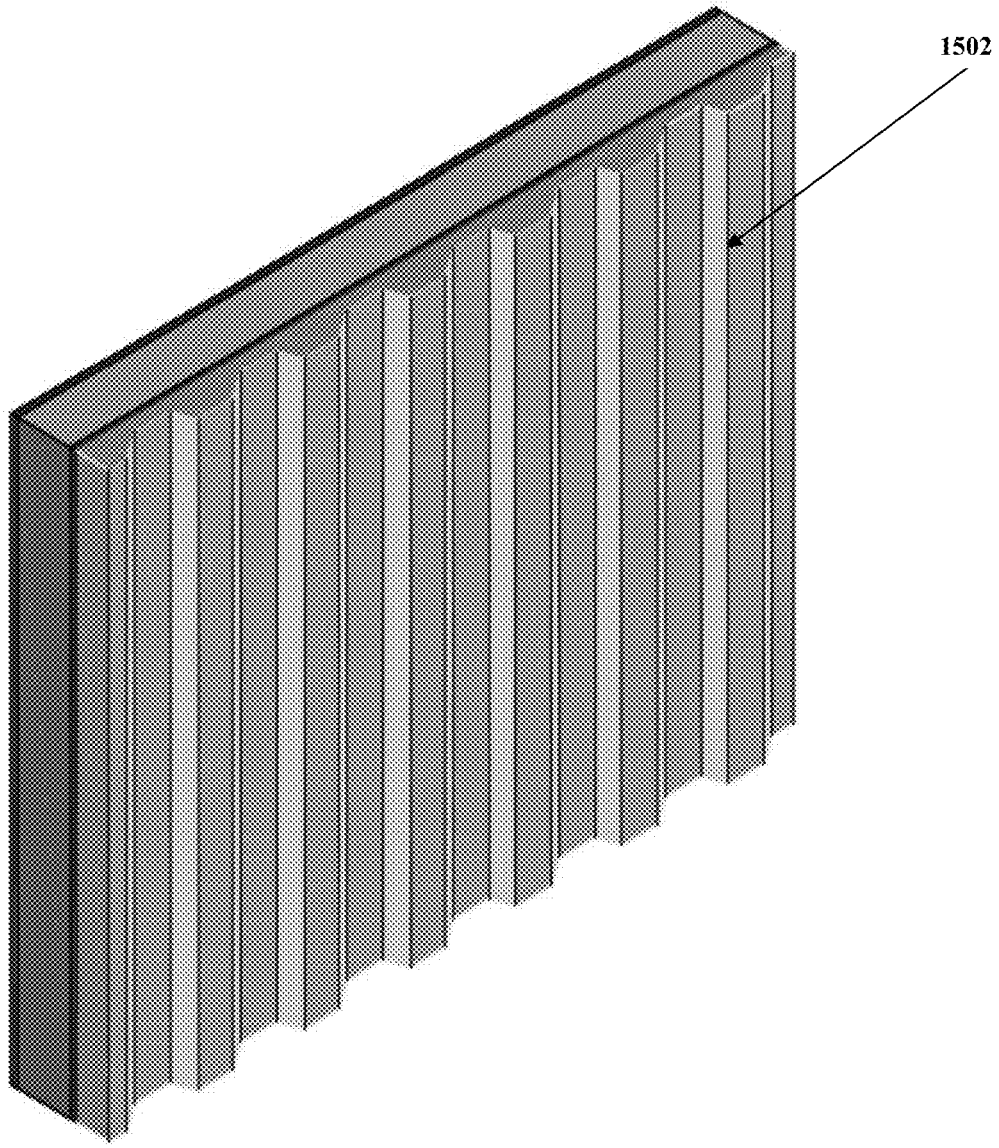
FIG. 15 shows the placement of additional components along a Covertec wall, in order to form a fence, according to an exemplary embodiment of the invention.

One side of the module edge includes an inset 116 mounted against the module's edge so that it nests inside the edge 302 of another module (FIG. 3-6). Such an insert makes a nesting assembly where a cavity 204/206 is a joint cavity 204/206 that is formed half by one panel 116/118, half by the other side of the panel 130 (with a small overlap of the panel end 116 which goes into the 130 end), so that the nesting of one inside the other creates a cavity 204/206 that is filled by concrete 106, cement, concrete and/or similar aggregate, a series of solid columns of 204/206 and 202 filled cavities of concrete forms along the length of the Covertec module formed wall. The rebars 110 from each side panel 700 are thus joined within the joint cavity 204/206 and upon solidification of the concrete 106 within the cavity, a column similar in function to column 202 forms a continuous wall of columns across two panels 100. In this fashion, one or more walls 700 are formed by two or more of said cavities 204/206 and 202 forms a contiguous single wall of successive cavities 120. Note the Covertec may be used as a standalone fence (FIG. 15), with the addition of optional noise reduction materials 1502 on the fascia.

When installing the unit 800 in the field the base slab 802 has one or more rebars 804 to act as floor attachments or similar mechanical features sticking out of the rebar surface. In this fashion, once the Covertec module 100 is installed, and filled with concrete, cement and/or similar aggregates, the floor rebar 804 becomes attached to the Covertec module 100 not at a point but along a significant height of the Covertec module and away from the mere joining area along the bottom 126 of the panel.

Successive modules 100 (902, 904, 906) in FIGS. 9-13 are then attached to the slab and to each other. A side wall for the house or dwelling 1000 will have regular height panels 100 as well as half height 1002 modules for windows and other openings 1004. In this fashion, internal dwelling spaces may have floor attachment internal rebars 1006 for attachment of internal wall modules. Once the module 100 is attached to the slab 802, the module opening(s) 120 and 204/206 are filled with concrete 1402, most usually from the top 124.

The above has a number of obvious advantages, these include lower construction costs, including less carpentry and associated labor, high efficiency, faster construction, quality control and easier assembly. The system has a large number of NAHB Model Green Home Building Guidelines.

In addition to the above, the wall modules 100 may be customized to the house model being built, adjusting their height/width of the fiber cement side panels 100 by cutting them and/or attaching additional length (epoxy glued to the other side panel 100 as well as to the interior wall 108. The panels are clamped together until the epoxy hardens.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A wall building module comprising;

two or more side walls;

two or more internal walls, each said internal wall placed orthogonally to said side wall and having a solid surface having one or more openings along its length, wherein each said internal wall attached to each said side wall forms one or more internal cavities along the height of said module having an open top and bottom;

said building module having a first vertical end formed by the last internal wall on said end, said first end having portions of said side walls extending past said internal wall, so as to form an open-sided C-shaped cavity;

said building module having a second vertical end formed by the last internal wall on said end, said first end having portions of said side walls extending past said internal wall, so as to form an open-sided C-shaped cavity;

wherein said first end has an insert mounted inside of each said side wall forming said C-shape cavity and extending past the edge of said side wall for at least half the length of said C-shape cavity and all along the height of said side wall so that when inserted into the second end a cavity is formed; and wherein said side walls, said internal walls and said insert are made from one or a combination of: fiber cement board, cellulose fiber, fiberglass, carbon composite and/or plywood.

2. The module of claim 1 wherein;

one or more rebars extend horizontally across the width of said module, going through said internal walls one or more openings and extending into a portion of each open-sided C-shaped cavity; and one or more vertical rebars extending from the bottom of said module to over the top.

3. A system for building walls comprising;

two or more wall building modules, each said module comprising:

two or more side walls;

two or more internal walls, each said internal wall having a solid surface having one or more openings along its length, wherein each said internal wall attached to each said side wall forms one or more internal cavities extending along the height of said module having an open top and bottom;

said building module having a first vertical end formed by the last internal wall on said end, said first end having portions of said side walls extending past said internal wall, so as to form an open-sided C-shaped cavity;

said building module having a second vertical end formed by the last internal wall on said end, said first end having portions of said side walls extending past said internal wall, so as to form an open-sided C-shaped cavity;

wherein said first end has an insert mounted inside of each said side wall forming said C-shape cavity and extending past the edge of said side wall for at least half the length of said C-shape cavity and all along the height of said side wall so that when inserted into the second end a cavity is formed;

one or more vertical rebars extending from the bottom of said module to over the top; and wherein two or more of said modules are concatenated so that one or more join cavities are formed at the juncture of said modules.

4. The system of claim 3 wherein;

said side walls and said internal walls are made from one or a combination of: fiber cement board, cellulose fiber, fiberglass, carbon composite and/or plywood.

5. A method for building walls comprising;

providing two or more wall building modules, each said module comprising:

two or more side walls;

two or more internal walls, each said internal wall having a solid surface having one or more openings along its length, wherein each said internal wall attached to each said side wall forms one or more internal cavities extending along the height of said module having an open top and bottom;

said building module having a first vertical end formed by the last internal wall on said end, said first end having portions of said side walls extending past said internal wall, so as to form an open-sided C-shaped cavity;

said building module having a second vertical end formed by the last internal wall on said end, said first end having portions of said side walls extending past said internal wall, so as to form an open-sided C-shaped cavity;

wherein said first end has an insert mounted inside of each said side wall forming said C-shape cavity and extending past the edge of said side wall for at least half the length of said C-shape cavity and all along the height of said side wall so that when inserted into the second end a cavity is formed;

one or more vertical rebars extending from the bottom of said module to over the top;

wherein two or more of said modules are concatenated so that one or more join cavities are formed at the juncture of said modules; and filling by concrete, cement and/or similar aggregates, one or more of said cavities individually until forming a concrete filled individual column.

6. The method of claim 5 wherein;

said side walls and said internal walls are made from one or a combination of: fiber cement board, cellulose fiber, fiberglass, carbon composite and/or plywood.

* * * * *